US005966961A

United States Patent [19]

Ziggiotto

[11] Patent Number: 5,966,961

[45] Date of Patent: Oct. 19, 1999

[54] APPARATUS FOR HEATING AND/OR REFRIGERATING FOOD IN GENERAL

[76] Inventor: Paolo Ziggiotto, Strada Bertesinella, 42, 36100 Vicenza, Italy

[21] Appl. No.: 08/802,702

[22] Filed: Feb. 19, 1997

[30] Foreign Application Priority Data

Feb. 21, 1996 [IT] Italy ..... VR96A0017

[51] Int. Cl.[6] ..... F25D 23/12; F25B 29/00

[52] U.S. Cl. ..... 62/331; 62/457.9; 62/336; 62/458; 62/198

[58] Field of Search ..... 62/331, 371, 457.9, 62/336, 458, 198, 62, 457.8, 159, 196.1, 199, 200

[56] References Cited

U.S. PATENT DOCUMENTS

| | | | |
|---|---|---|---|
| 2,412,774 | 12/1976 | Hoffman | 62/116 |
| 2,481,228 | 9/1949 | Layne | 62/457.9 |
| 2,555,425 | 6/1951 | Stern | 62/458 |
| 2,597,745 | 5/1952 | Morrison . | |
| 3,308,633 | 3/1967 | Kritzer | 62/239 |
| 3,481,154 | 12/1969 | Johnson | 62/439 |
| 4,288,991 | 9/1981 | Weeks | 62/183 |
| 4,355,521 | 10/1982 | Tsai . | |
| 4,711,099 | 12/1987 | Polan et al. | 62/457.9 |
| 4,722,197 | 2/1988 | McEntire . | |
| 5,220,807 | 6/1993 | Bourne et al. | 62/238.6 |

FOREIGN PATENT DOCUMENTS

| | | |
|---|---|---|
| 1017516 | 12/1952 | France . |
| 2301788 | 9/1976 | France . |
| 2414432 | 10/1975 | Germany . |
| 329164 | 8/1954 | Switzerland . |
| 2165041 | 4/1986 | United Kingdom . |

*Primary Examiner*—William Doerrler
*Attorney, Agent, or Firm*—Guido Modiano; Albert Josif

[57] ABSTRACT

A heating or refrigeration apparatus comprising a refrigeration circuit which includes an evaporator, a condenser, a compressor, and a valve or capillary duct for expansion between the condenser and the evaporator. It also includes a seat or space for material to be temperature-conditioned at the evaporator and at the condenser, each seat being arranged in a heat-exchange relationship with at least one portion of duct of the evaporator or of the condenser of the refrigeration circuit.

8 Claims, 3 Drawing Sheets

APPARATUS FOR HEATING AND/OR REFRIGERATING FOOD IN GENERAL

BACKGROUND OF THE INVENTION

The present invention relates to a heating and/or refrigeration apparatus, particularly but not exclusively adapted for processing food stuffs in general.

SUMMARY OF THE INVENTION

A principal aim of the present invention is to provide a heating and/or cooling apparatus which can be used as an electric household appliance for food, including food packaged in a container or vessel of any kind, whether made of metal or glass or synthetic material or other adapted material.

An object of the present invention is to provide a food heating and/or refrigeration apparatus which can be used as a display counter capable of refrigerating food stuffs and of keeping them cool, while heating other foods and keeping them hot or warm.

Another object of the present invention is to provide a heating and/or refrigeration apparatus as specified above which is relatively easy to manufacture, simple and practical to use, and entails very low electric power consumption.

This aim, these objects, and others which will become better apparent hereinafter are achieved by a heating and/or refrigeration apparatus according to the invention, comprising a refrigeration circuit which includes an evaporator, a condenser, a compressor, and a valve or capillary duct for expansion of a refrigerating medium between the condenser and the evaporator, at least one seat or space to be temperature-conditioned arranged in a heat-exchange relationship with at least one portion of duct of the said evaporator and at least one seat or space to be temperature-conditioned arranged in a heat-exchange relationship with at least one portion of duct of the said condenser.

Advantageously, the temperature of each seat or space to be heated or refrigerated is controlled by a control means arranged to cut off the operation of the refrigerating circuit when preset temperature levels are reached.

BRIEF DESCRIPTION OF THE DRAWINGS

Further characteristics and advantages of the present invention will become apparent from the following detailed description of some embodiments thereof, illustrated only by way of non-limitative example in the accompanying drawings, wherein.

DESCRIPTION OF THE PREFERRED EMBODIMENTS

Figure 1:
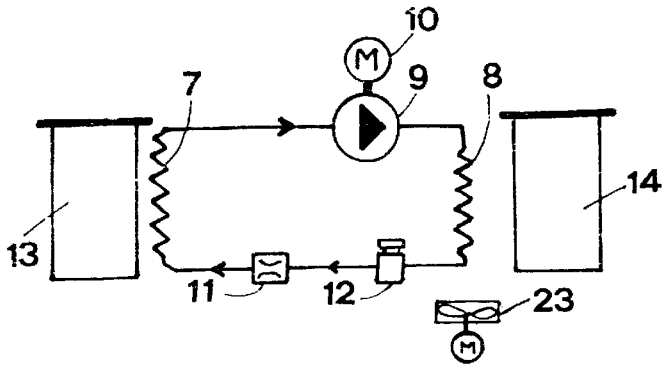
FIG. 1 is a general diagram of a heating and/or refrigeration apparatus according to the present invention.
Figure 2:
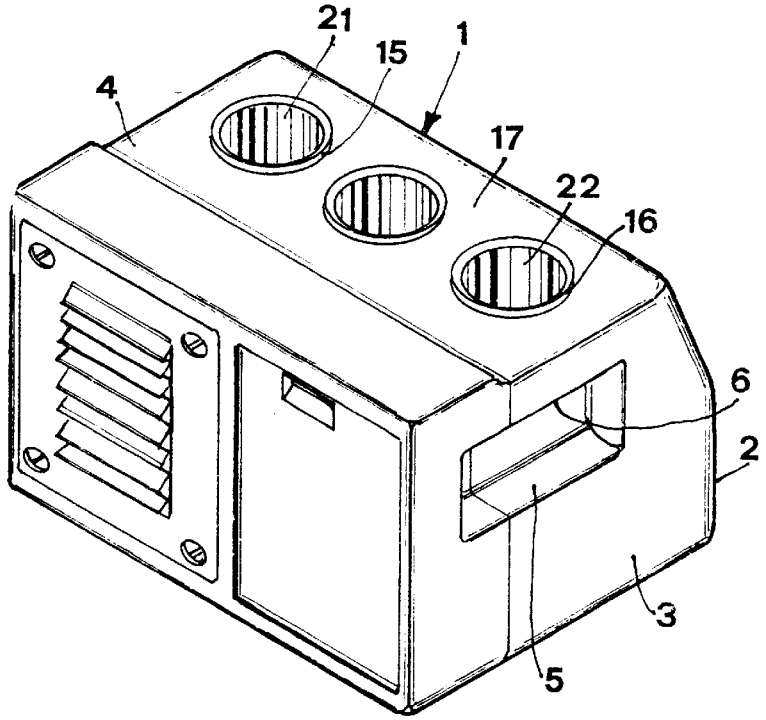
FIG. 2 is a perspective view of a heating and/or refrigeration apparatus configured and used as an electric household appliance.
Figure 3:
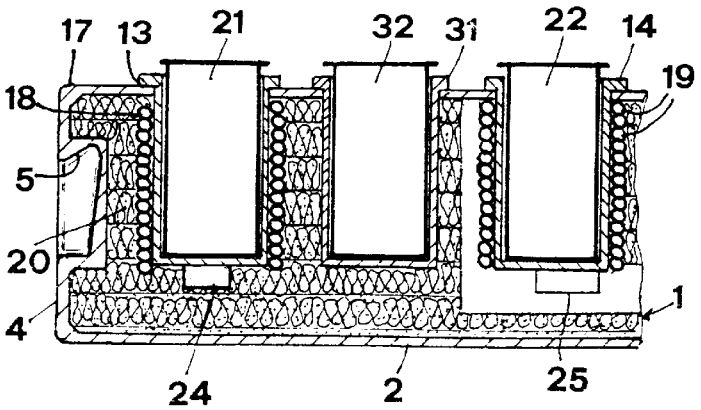
FIG. 3 is a sectional view, taken along the line III—III of FIG. 2.

In the various figures of the accompanying drawings, identical or similar parts or components have been designated by the same reference numerals.

Initially with reference to FIGS. 1 to 4, it will be noted that a heating and/or refrigeration apparatus 1 according to the invention is formed by a receiving case 2, preferably of the type having two opposite sides 3 and 4 affected by a recess 5 which delimits an upper abutment 6 constituting a recessed handle for easily gripping and handling the apparatus 1. The case 2 accommodates a refrigeration circuit, which comprises an evaporator 7, a condenser 8, a compressor 9 provided with an electric motor 10, and a valve or a capillary duct 11 for expansion between the compressor and the evaporator. Preferably, upstream of the valve or capillary duct 11 there is provided, as usual, a filter 12 for the fluid medium that flows throughout the refrigeration circuit, such as an environmentally-safe coolant.

At both the evaporator 7 and the condenser 8 there is provided a seat or support made of a heat-conducting material, e.g. a metal container 13 for refrigeration and 14 for heating, which is made for example of stainless steel, is provided with a flange at the top and is supported at its flange on the rim of a respective hole 15 and 16 formed in the upper wall 17 of the case 2. Each seat or support 13 and 14 is arranged in a heat-exchange relationship with at least one duct portion of the evaporator 7 and of the condenser 8 of the refrigeration circuit, respectively. The said duct portion is arranged, for example, around the said container in the shape of a helical coil, designated by the reference numerals 18 and 19 respectively.

Advantageously, a covering or embedding material 20 is provided around each coil 18 and around the respective container 13, which is constituted for example by foamed polyurethane, which ensures heat insulation in order to limit dissipation and formation of condensation.

Inside each seat 13 and 14 it is possible to locate a respective removable metallic vessel 21 and 22 which, like the respective seat, can have various configurations according to requirements. The product to be refrigerated, in the case of the vessel 21, or to be heated, in the case of the vessel 22, is placed in the vessels 21 and 22, optionally with its own packaging, such as for example a bottle which contains a beverage or a package of precooked dishes, etcetera.

Part of the coil 19 of the condenser is exposed to the cooling action by an electric fan 23, so that the heating produced by the heat transferred from the condenser to the seat 14 is prevented from exceeding a preset temperature threshold.

For this purpose, the temperature of each seat 13 and 14 is controlled by a respective thermostat 24 and 25, for example of the contact type, designed to cut off the operation of the compressor 9 when preset temperature levels, set in the thermostats themselves, are reached. The thermostat 25 is also designed to independently control the motor of the electric fan 23 whenever the temperature of the heating container 14 exceeds a preset threshold.

Figure 4:
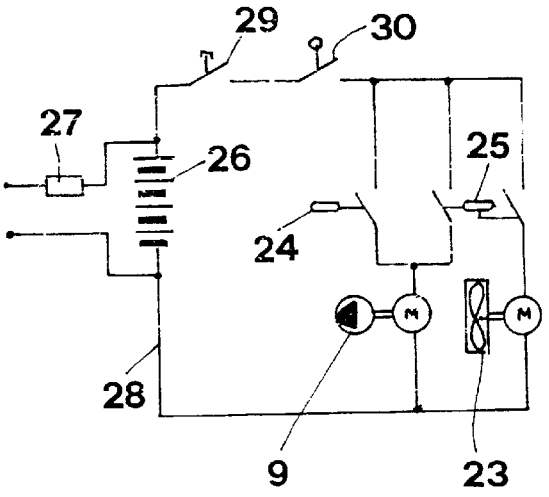
FIG. 4 is an electrical diagram of a heating and/or refrigeration apparatus according to the invention, powered by a battery.

This embodiment entails a direct-current power supply, provided for example by a battery 26 (for example a car battery) for example 5–6 hours at the most per day, which supplies an electric circuit 28 including the motor 9 of the compressor and the motor of the electric fan 23, the thermostats 24 and 25, a main switch 29, and preferably a timer 30 (FIG. 4).

Of course, the heating and/or refrigeration apparatus described above can also be supplied by AC mains power, for example at 220 V, with a total consumption of only 100 W during maximum power absorption, allowing to simultaneously refrigerate and heat two separate masses of products, even different products, for example refrigerating a bottled beverage placed in the vessel 21 in the refrigeration seat 13, while heating a precooked dish placed in the vessel 22 inside the heating seat 14.

It will be easily understood by an expert in this field that the operation of the apparatus according to the invention is very simple. The compressor 9 through its outlet supplies refrigerating gas (in its gaseous phase and thus relatively warm) to the condenser 8 and therefore also to the coil 19. The gas, while condensing, gives off heat to the heating seat 14, and at the outlet of the condenser 8 it is in its liquid phase, which is then filtered by the filter 12 and passes through the capillary duct 11, ready for being evaporated while flowing through the evaporator 7, wherefrom the cooling gas comes out still in its vapor phase owing to the suction effect of the compressor 9.

If required, between the seats 13 and 14, it is possible advantageously to provide an intermediate compartment 31 with a respective removable vessel 32, which can constitute a compartment for accommodating material waiting to be heated or refrigerated. Said compartment 31 can also constitute a space which contributes to maintain a better heat balance between the refrigeration seat 13 and the heating seat 14.

Figure 5:
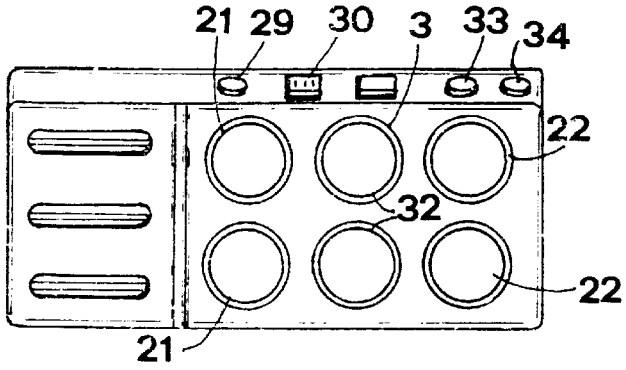
FIG. 5 is a plan view of a second embodiment of a heating and/or refrigeration apparatus according to the invention, with a plurality of seats or supports both for heating and refrigeration.

FIG. 5 schematically illustrates an embodiment with a plurality of heating and refrigeration seats and controls for setting the timer 30, a thermometer 33 for measuring the temperature of the refrigeration seats, and a thermometer 34 for detecting the temperature of the heating seats.

Typically, the maximum threshold values for the cooling seat or seats are around −5° C., preferably between 0° C. and +5° C., whilst those for the heating seat or seats are +70° C., preferably between 30° C. and 40° C.

Figure 6:
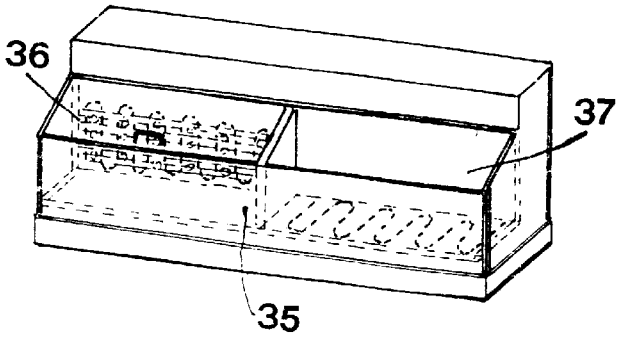
FIG. 6 is a perspective view of a third embodiment of a heating and/or refrigeration apparatus according to the invention, used as a display counter for food products.

The display counter 35 of FIG. 6 operates according to the same principle; on one side it has a display area 36 for dishes to be heated or kept warm, and on the other side it has a display area 37 for products to be refrigerated or kept cold, e.g. fresh fish or vegetables, all this at a very low energy consumption and with the possibility of simultaneously utilizing the heat generated and the heat absorbed by a refrigeration system.

In the embodiment illustrated in FIG. 7, the remote portion 40 (i.e., the one nearest to the inlet of the compressor 9) of the coil 18 of the evaporator 7 is exposed to the ventilating action by an electric fan 41, so that the temperature decrease caused by the heat absorbed by the evaporator from the seat 13 is prevented from dropping below a preset safety temperature threshold, below which undesired imbalances in the entire refrigeration circuit might occur. Moreover, for similar reasons the remote portion 42 (i.e., the most remote from the delivery of the compressor 9) of the coil 19 of the condenser 8 is exposed to the cooling action of the electric fan 23, so that the heating caused by the heat given off by the condenser to the seat 14 is prevented from exceeding a preset temperature level.

The temperature at the seats 13 and 14 is detected by two respective control probes 43 and 44, which are electrically connected to a respective input of a control unit or board of any adapted kind, generally designated by the reference numeral 45.

Should the auxiliary action of the fan 41 not be required, and in order to prevent useless load and heat losses along the refrigeration circuit, the remote ventilated portion 40 of the evaporator 7 can be bypassed by the refrigerant along a bypass 46 because of the presence of an electric valve 47 of any adapted kind, driven by the control unit 45.

Likewise, should the auxiliary action of the fan 23 on the remote ventilated portion 42 of the condenser 8 not be required, said portion can be bypassed by the refrigerant along a shunt or bypass 48 because of the presence of an electric valve 49 of any adapted kind, controlled by the electronic control unit 45.

Upstream of the condenser 8 there is preferably provided a coil 50 arranged to cause the evaporation of possible condensation formed at the remote ventilated portion 40 of the evaporator.

The electronic control unit 45 also controls two digital displays 51 and 52 designed to indicate the average temperature in the seats 13 and 14, respectively.

Figure 7:
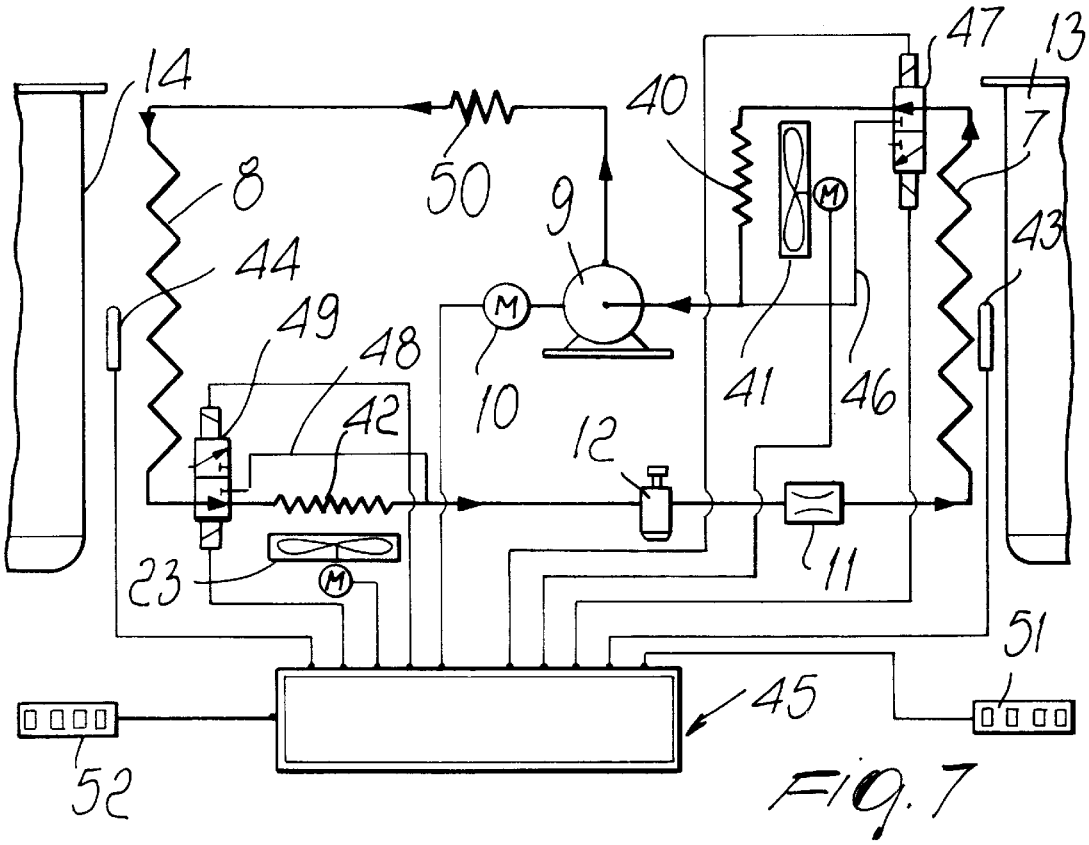
FIG. 7 is a schematic view of a fourth embodiment of a heating and/or refrigeration apparatus controlled by an electronic control unit or board.

A heating and/or refrigeration apparatus as shown in FIG. 7 is of highly regular and safe operation, thereby avoiding problems, especially those connected to excessive heating.

Figure 8:
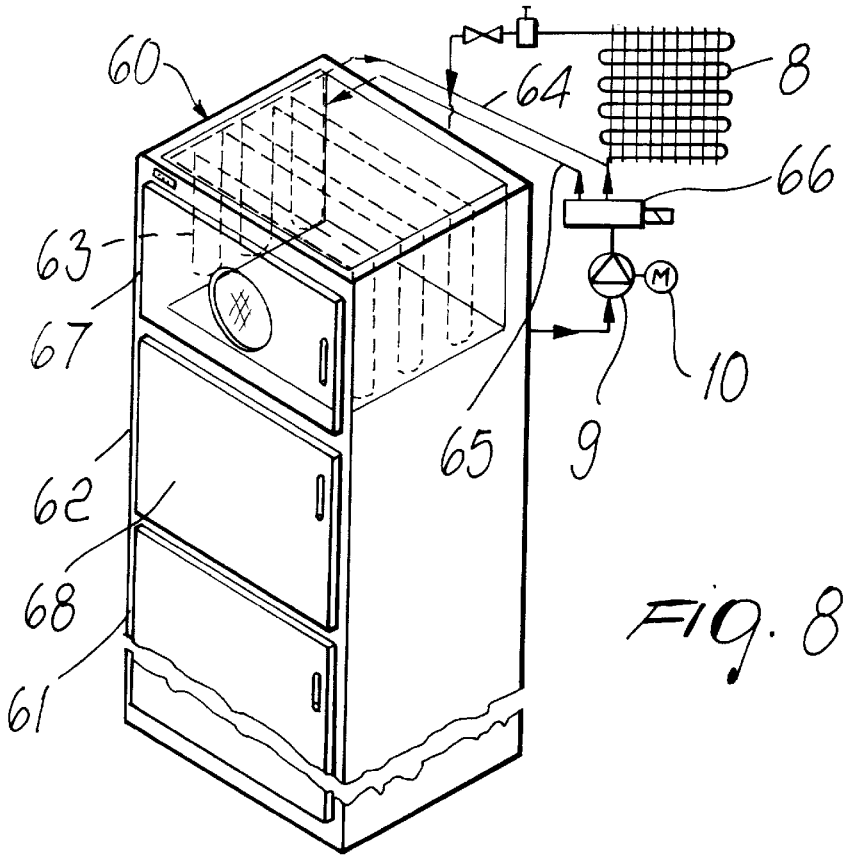
FIG. 8 is a schematic perspective view of a kitchen refrigerator provided with a freezer chamber topped by a heating chamber for heating food in general.

FIG. 8 illustrates an embodiment of the present invention, comprising a heating chamber 60 located for example at the top of a household refrigerator 61, optionally provided with a freezer chamber 62. The heating of the heating chamber 60 is ensured by a warmer initial portion 63 of the condenser 8, which surrounds, for example along a zigzag path, at least one internal compartment of the heating chamber 60. The outlet 64 of the initial portion 63 is connected to the inlet of the condenser 8, whilst its inlet 65 is controlled by an electric bypass 66 located along the outlet duct of the compressor 9.

The heating chamber 60 has a front door 67 for access to its internal compartment, in a manner fully similar to the underlying door 68 of the freezer 62.

The heating and/or refrigeration apparatus described above is susceptible of numerous modifications and variations within the scope of the appended claims.

Thus, for example, instead of or in addition to the heating vessels 22, pans or plates, optionally perforated or in any case provided with openings for the circulation of the hot air generated in the heating seat or seats, can be provided for supporting trays or other containers for food to be heated.

The advantages of a heating and/or refrigeration apparatus according to the invention with respect to a conventional portable refrigerator or a heat storage system are numerous. First of all, as mentioned above, it makes it possible to utilize, with high efficiency, even simultaneously, both the released heat and the generated cold, and secondly to reduce or increase the temperature and keep it at preset levels, offering a considerable capability. The entire system can be confined within quite compact overall dimensions.

Typical fields of application of a heating and/or refrigeration apparatus are:

camp stoves at building sites, equipment for camping, boating, hobbies, small catering services, laboratories, car industry, aeronautics, transport vehicles in general and the like.

What is claimed is:

1. A heating and/or refrigeration apparatus comprising a compressor;

an evaporator comprising cooling coil means;

a remote evaporator portion located downstream with regard to said evaporator;

a condenser comprising heating coil means;

a remote condenser portion located downstream with regard to said condenser;

an expansion duct between the conductor and the evaporator;

tubular connecting and fluid circulating means between said condenser and said evaporator;

at least one volume-containing space to be temperature-conditioned arranged in a heat-exchange relationship with at least one portion of said evaporator cooling coil means;

at least one volume-containing space to be temperature-conditioned arranged in a heat-exchange relationship with at least one portion of said condenser heating coil means;

temperature control probes in proximity of said condenser and responsive to the temperature level thereof;

temperature control probes in proximity of said evaporator and responsive to the temperature level thereof;

a control unit connected to said condenser temperature control probe and to said evaporator temperature control probe, capable of operating said compressor at a certain temperature threshold;

at least one electric fan in proximity of said evaporator remote portion for controlled cooling of said remote portion upon reaching a preset temperature threshold, detected by said temperature control probes and at least one electric fan in proximity of said condenser remote portion for controlled cooling of said remote portion upon reaching a preset temperature threshold, detected by said temperature control probes.

2. A heating and/or refrigeration apparatus comprising a compressor;

an evaporator comprising cooling coil means;

a remote evaporator portion located downstream with regard to said evaporator;

a condenser comprising heating coil means;

a remote condenser portion located downstream with regard to said condenser;

an expansion duct between the conductor and the evaporator;

tubular connecting and fluid circulating means between said condenser and said evaporator;

at least one volume-containing space to be temperature-conditioned arranged in a heat-exchange relationship with at least one portion of said evaporator cooling coil means;

at least one volume-containing space to be temperature-conditioned arranged in a heat-exchange relationship with at least one portion of said condenser heating coil means;

temperature control probes in proximity of said condenser and responsive to the temperature level thereof;

temperature control probes in proximity of said evaporator and responsive to the temperature level thereof;

bypass conduit and bypass electric valve means for short cutting said condenser remote portion;

bypass conduit and bypass electric valve means for short cutting said evaporator remote portion;

a control unit connected to said condenser temperature control probe and capable of operating said bypass electric valve means to short cut said condenser remote portion through said bypass conduit at a certain temperature threshold, and connected to said evaporator temperature control probe and capable of operating said bypass electric valve means to short cut said evaporator remote portion through said bypass conduit at a certain temperature threshold;

at least one electric fan in proximity of said condenser remote portion for controlled cooling of said remote portion upon reaching a preset temperature threshold, detected by said temperature control probes and at least one electric fan in proximity of said evaporator remote portion for controlled cooling of said remote portion upon reaching a preset temperature threshold, detected by said temperature control probes.

3. An apparatus according to claim 1, said temperature control probes comprising at least one thermostat.

4. An apparatus according to claim 1, comprising at least one standby volume-containing space at room temperature.

5. An apparatus according to claim 1, comprising an evaporation coil upstream of the condenser to ensure the evaporation of any residual condensation.

6. An apparatus according to claim 1, comprising a filtering device for the fluid of the refrigeration circuit.

7. An apparatus according to claim 1, comprising gripping means on at least on one side of the frame of said apparatus.

8. An apparatus according to claim 1, having a portable light-weight frame for containing products to be heated or kept warm and to be refrigerated or kept cold.

* * * * *